US006832685B2

(12) United States Patent
Chang

(10) Patent No.: US 6,832,685 B2
(45) Date of Patent: Dec. 21, 2004

(54) COMPOSITE ROTARY TOOL KIT

(76) Inventor: Hungming Chang, No. 3-1, Lane 63, Sec. 3, Jungshan Rd., Junghe City (TW)

( * ) Notice: Subject to any disclaimer, the term of this patent is extended or adjusted under 35 U.S.C. 154(b) by 121 days.

(21) Appl. No.: 10/372,829

(22) Filed: Feb. 26, 2003

(65) Prior Publication Data

US 2004/0163983 A1 Aug. 26, 2004

(51) Int. Cl.[7] ..... B65O 85/62

(52) U.S. Cl. ..... 206/376; 206/372; 206/377; 206/759; 211/70.6

(58) Field of Search ..... 206/372, 373, 206/376, 377, 378, 379, 443, 747, 748, 759; 211/69, 70, 70.6

(56) References Cited

U.S. PATENT DOCUMENTS 4,006,821 A * 2/1977 Sautter ..... 206/379
4,598,822 A * 7/1986 Hemmings ..... 206/379
5,676,253 A * 10/1997 Hsu ..... 206/748
5,813,533 A * 9/1998 Knoblauch ..... 206/379
6,398,027 B1 * 6/2002 Ryu ..... 206/362

* cited by examiner

*Primary Examiner*—John A. Ricci
(74) *Attorney, Agent, or Firm*—Birch, Stewart, Kolasch & Birch, LLP

(57) ABSTRACT

A composite rotary tool kit includes a plurality of coupling units and a connecting element for fastening the coupling units to form a string. Each coupling unit has a barrel type body with a housing duct located on the peripheral surface for holding a tool. The body has one side forming a stepwise slip-resisting section for coupling with the body of another coupling unit. The coupling unit has a hole in the center to enable the connecting element to run through. The slip-resisting section has a ridge mating a latch unit on the body. The coupling units may hold tools of different specifications and are turnable to facilitate retrieving of the tools.

7 Claims, 7 Drawing Sheets

COMPOSITE ROTARY TOOL KIT

FIELD OF THE INVENTION

The present invention relates to a tool kit for holding hexagonal wrenches of various specifications and particularly to a composite rotary tool kit for holding a plurality of hand tools of different specifications on an integrated string and is turnable for retrieving of the hand tools.

BACKGROUND OF THE INVENTION

A conventional hand tool kit for holding hexagonal wrenches such as the one shown in FIG. 1 mainly includes a box 5 which has a plurality of insert holes 51 formed on one side to hold hexagonal wrenches 6 of different specifications. It allows multiple pieces of hexagonal wrenches 6 of different sizes to be held together in the box 5 so that users may select any one required to fasten or unfasten the bolt head of various hexagonal cavities. However, the hexagonal wrenches 6 of different sizes are held on the box 5 in the same direction. To fetch any one of them when in use often is interfered by the neighboring wrenches. This is especially troublesome for retrieving the wrenches of a smaller size because the bigger wrenches on the neighborhood often hinder the retrieval activities.

SUMMARY OF THE INVENTION

The primary object of the invention is to provide a composite rotary tool kit that has a connecting element to fasten a plurality of coupling units together. Each coupling unit has a body which has a periphery extending to form a housing duct to receive a hexagonal wrench. The coupling unit has one side formed a stepwise slip-resisting section which has a peripheral surface with a plurality of ridges to couple with a latch unit located in the body. Thus it can hold hand tools of different specifications. Moreover, the coupling units may be turned to facilitate retrieval of the hand tools.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
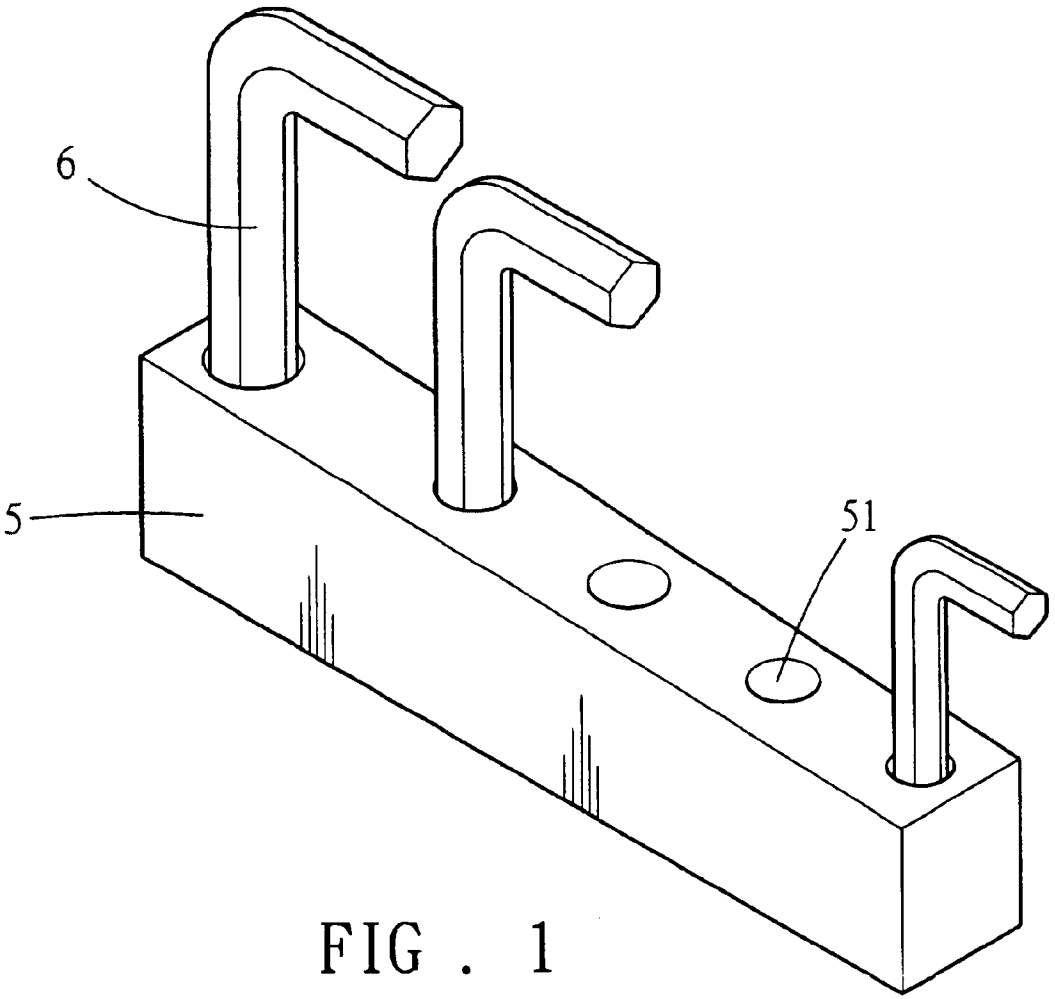
FIG. 1 PRIOR ART
FIG. 1 is a perspective view of a conventional hand tool kit.
Figure 2:
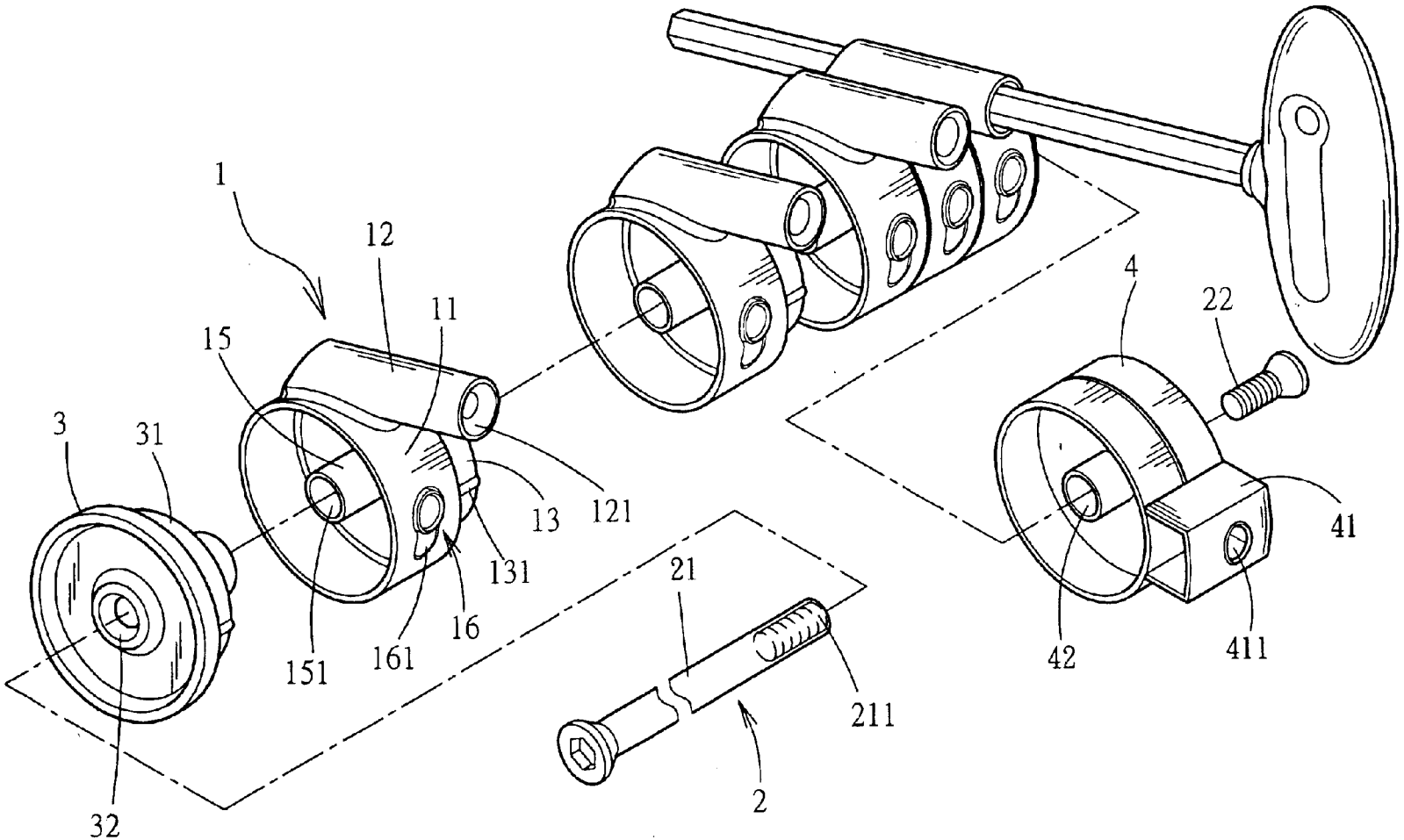
FIG. 2 is an exploded view of an embodiment of the invention.

Referring to FIG. 2, the composite rotary tool kit of the invention includes a plurality of coupling units 1, a connecting element 2 for fastening the coupling units 1 to become a string, a left cap 3 and a right cap 4.

Figure 4A:
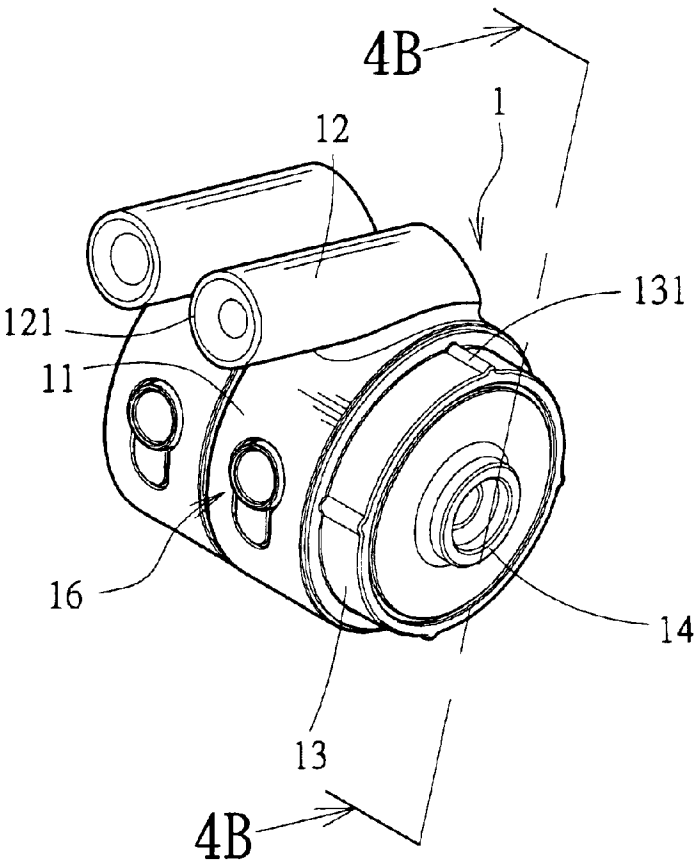
FIG. 4A is a perspective view of the invention with two coupling units coupled together.
Figure 3:
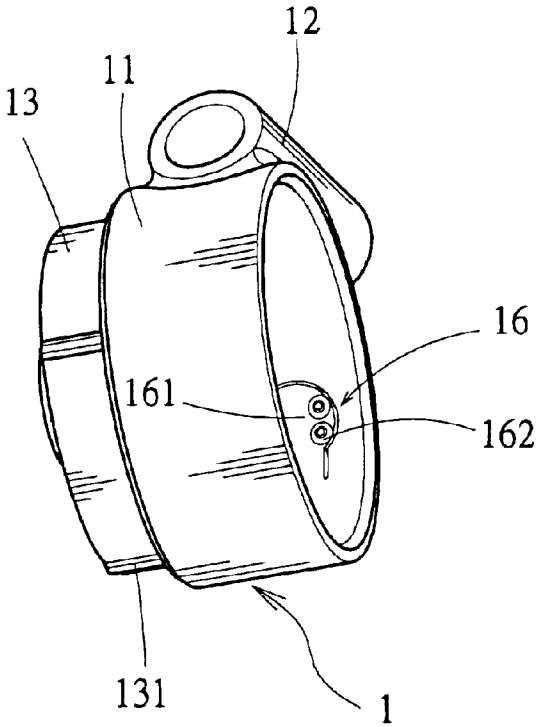
FIG. 3 is a perspective view of a coupling unit of the invention.
Figure 4B:
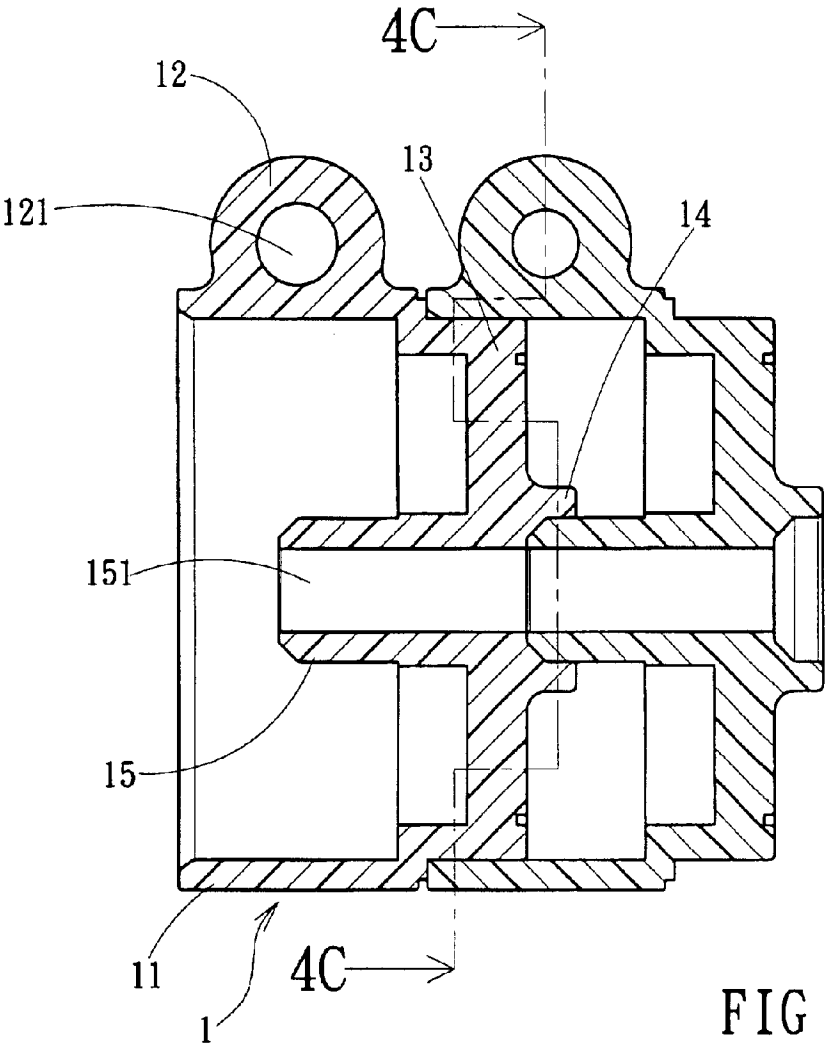
FIG. 4B is a cross section taken on line 4B—4B in FIG. 4A.
Figure 4C:
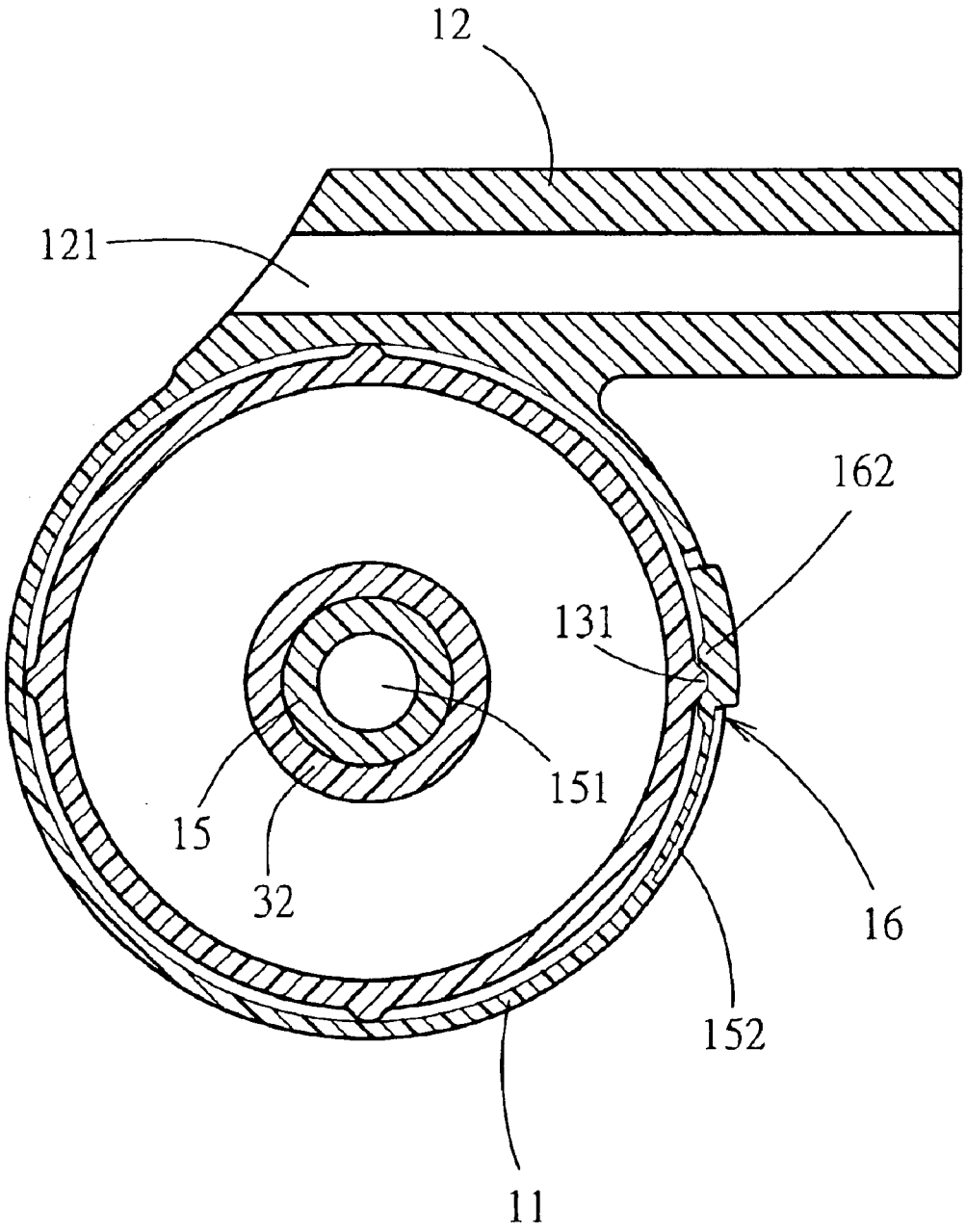
FIG. 4C is a cross section taken on line 4C—4C in FIG. 4B.

Referring to FIG. 3, the coupling unit 1 has a hollow body 11 on one side. On a tangent line of the outer wall of the body 11, there is a housing duct 12 which has an insert hole 121 in the center to receive a tool such as a hexagonal wrench. The body 11 has one side formed a stepwise perimeter of a smaller diameter to become a slip-resisting section 13. The slip-resisting section 13 has a peripheral surface on which four ridges 131 are formed thereon in an equally spaced manner. The slip-resisting section 13 is extended on a radial surface to form a circular connecting section 14. As shown in FIG. 4A, the connecting section 14 has an axial hollow axle strut 15 extending to the interior of the body 11. The axle strut 15 has a hole 151 in the center running through the center of the body 11. There is a latch unit 16 located on the peripheral wall of the body 11. Referring to FIG. 4C, the latch unit 16 includes a latch plate 161 located in a cut out arched opening formed on the body 11. The latch plate 161 may be bent inwards or outwards under compression. The latch plate 161 further has a pair of spaced and parallel ribs 162 formed on an inner wall to clip any one of the ridges 131 of the slip-resisting section 13.

The connecting element 2 is a cylindrical member 21 which has a screw hole 211 on a distal end to engage with a bolt head 22.

The left cap 3 has an inner peripheral rim 31 to couple with the opening end of the body 11 of the leftmost coupling unit 1. The left cap 3 has a center hole 32 to allow the connecting element 2 to run through.

The right cap 4 is hollow and has a rectangular shell 41 extending outwards from one side. The shell 41 has a hanging hole 411 formed on the front side. The right cap 4 also has a center hole 42 to allow the connecting element 2 to run through.

Figure 5:
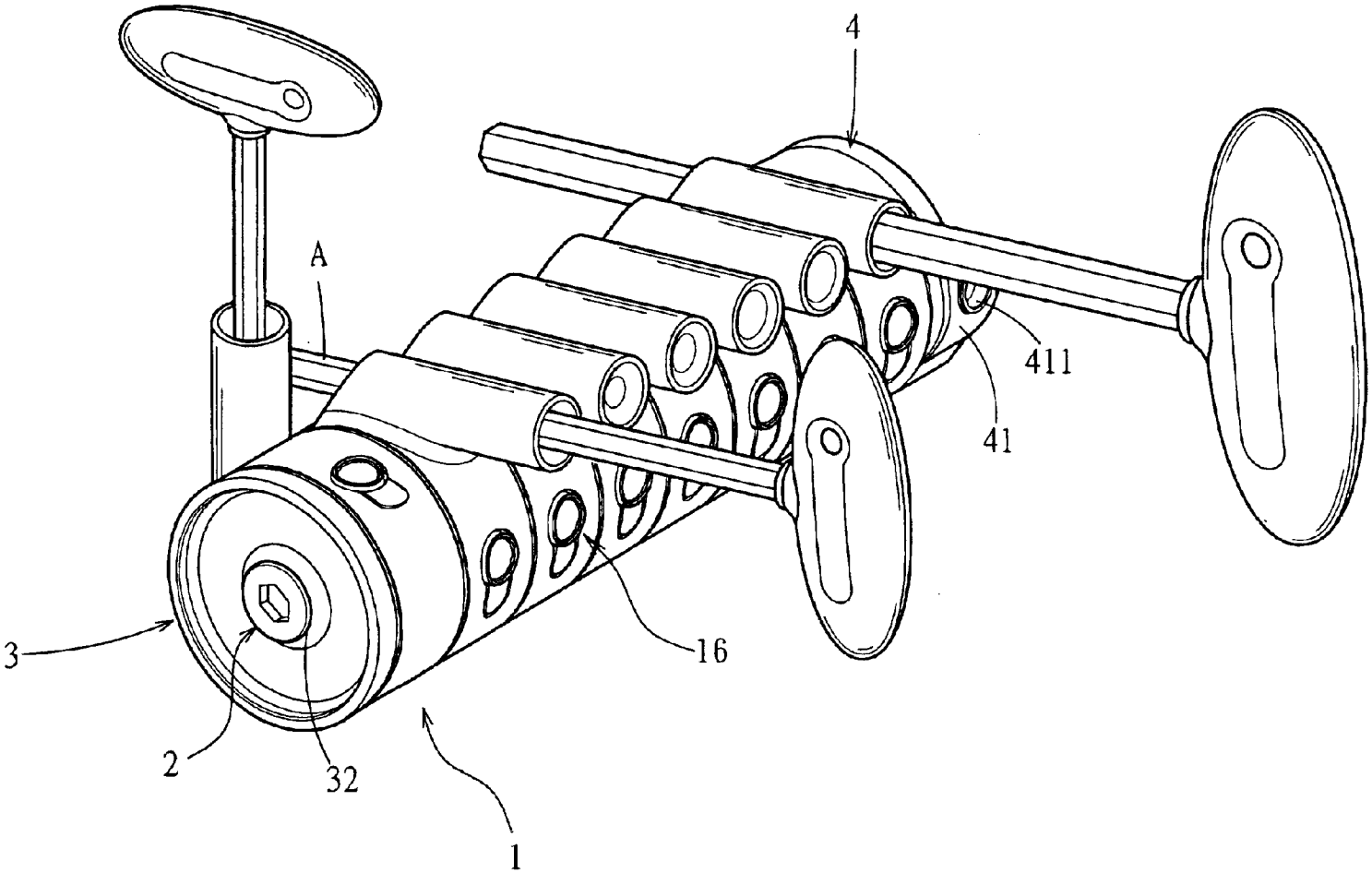
FIG. 5 is a schematic view of an embodiment of the invention in use.

Referring to FIGS. 2 and 5, the insert holes 121 of the housing ducts 12 on the coupling units 1 have different sizes to hold a plurality of tools of different sizes. As shown in FIGS. 4B and 4C, to assemble a plurality of coupling units 1, first, couple and anchor the body 11 of the first coupling unit to the slip-resisting section 13 of the second coupling unit 1 by clipping the ridge 131 on the peripheral surface of the slip-resisting section 13 between the two ribs 162 of the body 11 of another coupling unit 1. This process is repeated until all the coupling units 1 are coupled to become a string. Then couple the outer side of the leftmost coupling unit 1 with the left cap 3, and couple the outer side of the rightmost coupling unit 1 with the right cap 4. Thereafter, have the connecting element 2 running through the center hole 32 of the left cap 3, the holes 151 of all coupling units 1 and the center hole 42 of the right cap 42. Finally fasten the bolt head 22 to the screw hole 211 on the distal end of the connecting element 2.

When in use, the tool kit may be hung on a wall through the hanging hole 411 of the right cap 4. When to fetch a tool, the coupling unit 1 where the targeted tool is held may be turned for an angle so that the target tool is apart from other tools. Then the targeted tool may be retrieved easily without interference from other tools.

Figure 6:
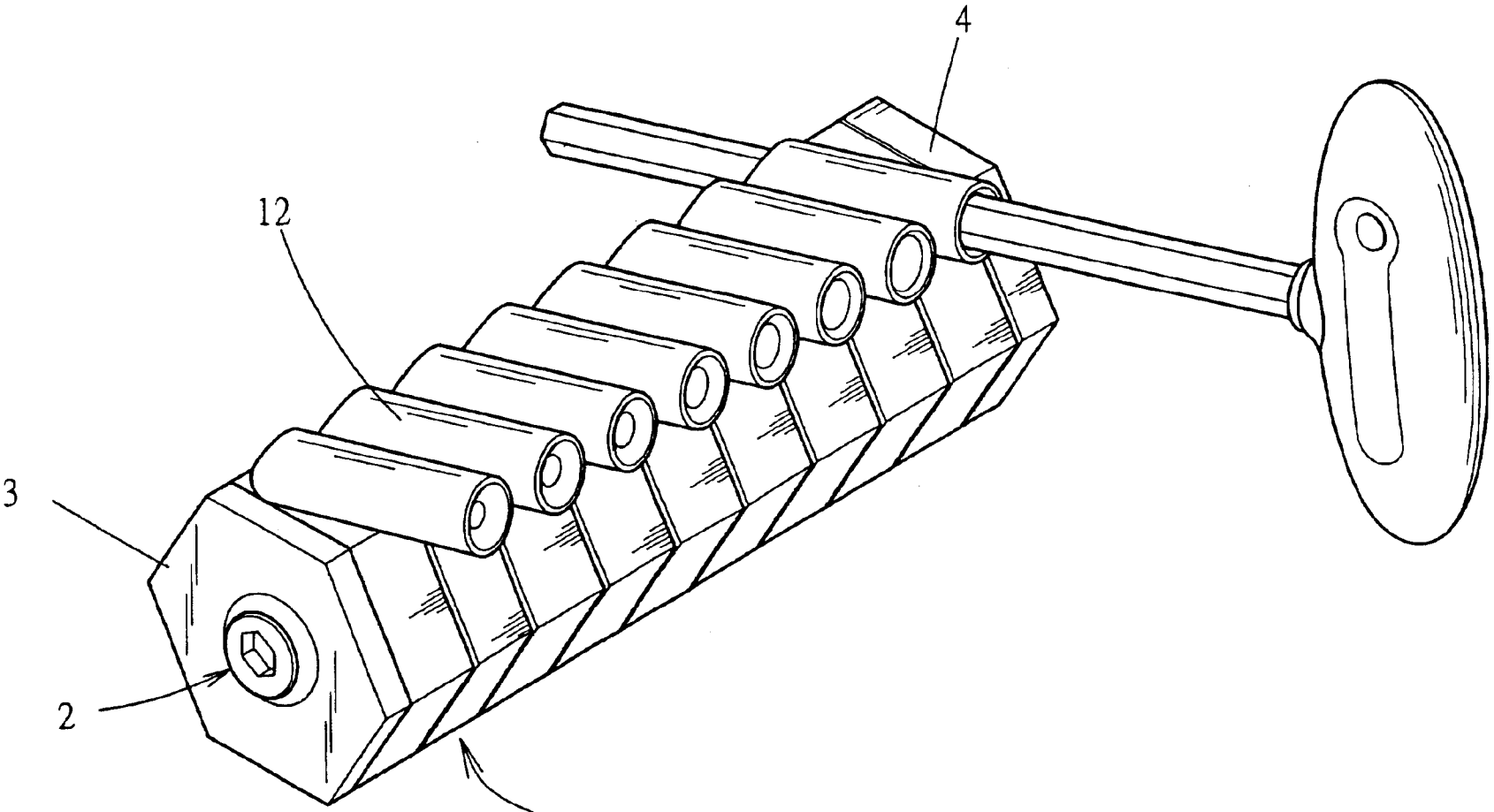
FIG. 6 is a perspective view of another embodiment of the invention

Referring to FIG. 6, the coupling units 1 and the left and the right caps 3 and 4 may also be made in a polygonal shape to facilitate laying on a flat surface.

What is claimed is:

1. A composite rotary tool kit, comprising:

a plurality of coupling units; and a connecting element for fastening the coupling units to form a string;

wherein each coupling unit has a body which has a housing duct located on an outer peripheral wall thereof for holding a tool and a slip-resisting section formed on one side thereof in a stepwise manner, the slip-resisting section having one side extended inwards to form a connecting section which is extended into the body to form an axial strut in the axial direction, the axle strut having a hole leading to the connecting section to receive the connecting element for coupling the coupling units to form the string;

wherein the number of the coupling units to be coupled is alterable according to the number of tools to be held, and the coupling units are turnable to selected angles to facilitate retrieving of the tools.

2. The composite rotary tool kit of claim 1, wherein the slip-resisting section has at least one ridge located on an outer peripheral wall thereof, the body having a latch unit to anchor the ridge.

3. The composite rotary tool kit of claim 2, wherein the latch unit includes a latch plate located in a cut out opening formed on the body, the latch plate having jutting ribs to constrain the ridge.

4. The composite rotary tool kit of claim 1, wherein the housing duct of the coupling unit has an insert hole, the insert holes of all coupling units having different sizes corresponding to the tools and being arranged from large to small.

5. The composite rotary tool kit of claim 1 further having a left cap and a right cap to couple respectively two sides of the coupling units.

6. The composite rotary tool kit of claim 5, wherein the right cap has a shell extending from an outer wall thereof, the shell having a hanging hole.

7. The composite rotary tool kit of claim 1, wherein the body coupling unit is polygonal.

* * * * *